US009010491B2

(12) United States Patent
Trang

(10) Patent No.: US 9,010,491 B2
(45) Date of Patent: Apr. 21, 2015

(54) LADDER SAFETY ACCESSORY KIT

(76) Inventor: Brian T. Trang, Naples, FL (US)

( * ) Notice: Subject to any disclaimer, the term of this patent is extended or adjusted under 35 U.S.C. 154(b) by 1076 days.

(21) Appl. No.: 12/626,727

(22) Filed: Nov. 27, 2009

(65) Prior Publication Data

US 2011/0127110 A1 Jun. 2, 2011

(51) Int. Cl.

| | |
|---|---|
| ***E06C 7/48*** | (2006.01) |
| ***E06C 7/42*** | (2006.01) |
| ***E06C 7/44*** | (2006.01) |
| ***E06C 7/46*** | (2006.01) |

(52) U.S. Cl.

CPC ... *E06C 7/48* (2013.01); *E06C 7/44* (2013.01); *E06C 7/46* (2013.01)

(58) Field of Classification Search

USPC ..... 182/107, 109, 111, 200, 201, 203, 204, 182/214, 229, 228.6, 151, 108, 129

See application file for complete search history.

(56) References Cited

U.S. PATENT DOCUMENTS

| | | | | |
|---|---|---|---|---|
| 799,782 | A | 9/1905 | Ellinger et al. | |
| 1,143,256 | A * | 6/1915 | Dewees | 33/451 |
| 2,196,640 | A | 4/1940 | Meier | |
| 2,503,626 | A | 4/1950 | Mayberry | |
| 2,559,961 | A * | 7/1951 | Howell | 33/374 |
| 3,456,757 | A * | 7/1969 | Sain | 182/111 |
| 3,708,080 | A | 1/1973 | Schlei | |
| 3,805,917 | A | 4/1974 | Luther | |
| 3,882,966 | A * | 5/1975 | Fasano | 182/205 |
| 4,147,231 | A * | 4/1979 | Chantler et al. | 182/172 |
| 4,606,432 | A * | 8/1986 | Belt | 182/204 |
| 4,949,925 | A * | 8/1990 | Gorecki | 248/238 |
| 5,103,569 | A * | 4/1992 | Leatherwood | 33/379 |
| 5,165,501 | A * | 11/1992 | Donahey | 182/214 |
| 5,167,075 | A * | 12/1992 | Weldy et al. | 33/343 |
| 5,273,133 | A * | 12/1993 | Thocher et al. | 182/202 |
| 5,476,153 | A | 12/1995 | Dickerson et al. | |
| 5,542,497 | A * | 8/1996 | Macyszyn | 182/201 |
| 5,551,529 | A * | 9/1996 | Molitor | 182/204 |
| 5,678,656 | A * | 10/1997 | Lanzafame | 182/205 |
| 5,713,135 | A * | 2/1998 | Acopulos | 33/451 |
| 5,740,881 | A | 4/1998 | Lensak | |
| 5,740,883 | A * | 4/1998 | Trank | 182/129 |
| 5,845,744 | A * | 12/1998 | Beck et al. | 182/204 |
| 5,850,894 | A | 12/1998 | Busenhart | |
| 5,899,296 | A | 5/1999 | Lantz | |
| 6,401,866 | B1 * | 6/2002 | Roy | 182/204 |
| 6,408,984 | B1 | 6/2002 | Cavagnaro | |
| 6,450,292 | B1 * | 9/2002 | Sheffield | 182/205 |
| 6,691,825 | B2 * | 2/2004 | Haig | 182/107 |
| 6,729,440 | B1 * | 5/2004 | Bailey | 182/204 |
| 6,785,977 | B1 * | 9/2004 | Crichton | 33/613 |
| 6,948,591 | B2 * | 9/2005 | Scott et al. | 182/201 |
| 7,032,711 | B1 * | 4/2006 | Katz et al. | 182/129 |
| 7,392,593 | B2 * | 7/2008 | Rivers et al. | 33/333 |

(Continued)

*Primary Examiner* — Daniel Cahn

(74) *Attorney, Agent, or Firm* — Livingston Loeffler, P.A.; Edward M. Livingston, Esq.; Bryan L. Loeffler, Esq.

(57) ABSTRACT

A ladder safety accessory kit (5) for straight and extension ladders (1) having an upper stabilizer assembly (2) that makes the ladder adaptable to any shaped structure or surface, a lower stabilizer assembly (3) that makes the ladder adjustable to accommodate for uneven ground, a leveling measurement device (4) that allows a user to quickly and easily determine that the ladder is level and angled correctly and a storage tray (36) that provides a storage area for tools and other items. The ladder safety accessory kit may be integrated with new ladders or used to retrofit existing ladders.

21 Claims, 7 Drawing Sheets

(56) References Cited

U.S. PATENT DOCUMENTS

| | | | | |
|---|---|---|---|---|
| 2001/0035313 | A1* | 11/2001 | Uridel et al. | 182/107 |
| 2002/0084143 | A1* | 7/2002 | Roy | 182/204 |
| 2003/0201139 | A1* | 10/2003 | Haig | 182/107 |
| 2005/0144796 | A1* | 7/2005 | Szumer | 33/379 |
| 2006/0207830 | A1* | 9/2006 | Gray et al. | 182/18 |
| 2006/0272899 | A1* | 12/2006 | Chang | 182/201 |
| 2007/0163839 | A1* | 7/2007 | Dangrow et al. | 182/204 |
| 2007/0193832 | A1* | 8/2007 | Dangrow et al. | 182/204 |
| 2007/0234483 | A1* | 10/2007 | Kunz et al. | 7/143 |
| 2007/0295556 | A1* | 12/2007 | Grinberg | 182/201 |
| 2008/0190697 | A1* | 8/2008 | Skurkis | 182/204 |
| 2008/0271330 | A1* | 11/2008 | Bender | 33/365 |

* cited by examiner

LADDER SAFETY ACCESSORY KIT

BACKGROUND OF THE INVENTION

This invention relates to safety devices for straight ladders and extension ladders, more particularly, a ladder safety accessory kit that levels, stabilizes and holds a ladder in place during use, thereby ensuring the safety of a user while climbing and/or performing work while on the ladder.

Many jobs require the use of ladders to reach areas that are not accessible or within reach of a person standing on the ground. Ladders are commonly used to climb onto roofs of houses and other buildings. Ladders are also used to perform jobs, such as painting, washing windows and so forth. Normally, the bottom portion of the ladder rests on the ground or other similar horizontal surface and the upper end of the ladder typically leans against the vertical wall surface of a building or work surface so that the ladder is oriented at an angle which makes it easy and safe for a user to climb up and down. The use of ladders can be very dangerous and is known to be a major cause of accidents. When a ladder is positioned against a structure, it is essential that the ladder be properly angled to prevent the base of the ladder from slipping. However, not every structure is a flat surface and the ground is not always perfectly level. In addition, most bases and or upper portions of most ladders are not adjustable and thus, cannot be adapted for use on a slanted ground or oddly shaped structure. Furthermore, users currently have no way to easily determine if a ladder is horizontally level and placed at a safe angle in relation to a structure. An even further problem with current ladders is the lack of storage space for tools and other items. Although, many ladders do provide trays for placing tools and other items while working on the ladder, these trays are only flat surfaces that do not secure the tools and/or prevent the tools from accidentally falling to the ground.

Therefore, a need exists for a ladder safety accessory kit that provides an upper stabilizer assembly for adjusting the top portion of a ladder to compensate and/or lock onto different shaped structures, a lower stabilizer assembly for adjusting the bottom portion of the ladder to compensate for uneven ground, a leveling measurement device for determining that the ladder is angled correctly and is level and a storage tray for safely storing tools and other items while working on the ladder.

The relevant prior art includes the following references:

| Pat. No. (U.S. unless stated otherwise) | Inventor | Issue/Publication Date |
|---|---|---|
| 6,408,984 | Cavagnaro | Jun. 25, 2002 |
| 5,899,296 | Lantz | May 04, 1999 |
| 5,850,894 | Busenhart | Dec. 22, 1998 |
| 5,740,881 | Lensak | Apr. 21, 1998 |
| 5,476,153 | Dickerson et al. | Dec. 19, 1995 |
| 5,273,133 | Thocher et al. | Dec. 28, 1993 |
| 3,805,917 | Luther | Apr. 23, 1974 |
| 3,708,080 | Schlei | Jan. 02, 1973 |
| 3,456,757 | Sain | Jul. 22, 1969 |
| 2,503,626 | Mayberry | Apr. 11, 1950 |
| 2,196,640 | Meier | Apr. 09, 1940 |
| 799,782 | Ellinger et al. | Sep. 19, 1905 |

SUMMARY OF THE INVENTION

The primary object of the present invention is to provide a ladder safety accessory kit that is adaptable to any shaped structure or surface.

Another object of the present invention is to provide a ladder safety accessory kit that adjusts to compensate for uneven ground.

An even further object of the present invention is to provide a ladder safety accessory kit allows a user to quickly and easily determine a ladder is angled correctly.

Another object of the present invention is to provide a ladder safety accessory kit that allows a user to quickly and easily determine that a ladder is level.

An even further object of the present invention is to provide a ladder safety accessory kit that provides a storage area for tools and other items.

The present invention fulfills the above and other objects by providing a ladder safety accessory kit having an upper stabilizer assembly, a lower stabilizer assembly, a leveling measurement device and a storage tray. The ladder safety accessory kit may be integrated with new ladders or used to retrofit existing ladders. Typically, a ladder has a front side that a user climbs, a rear side that faces a structure, an upper portion that rests against a structure, a lower portion that rests on the ground, sides, and a plurality of rungs in-between the sides. The upper stabilizer assembly is located on the upper portion of the ladder. The upper stabilizer assembly comprises upper vertical adjustment bars located on both sides of the ladder. Stabilizer bars are slidably attached to the upper vertical adjustment bars, thereby allowing a user to adjust the position of the stabilizer bars on the ladder. The stabilizer bars are also pivotally attached to the vertical adjustment bars, thereby allowing a user to fold the stabilizer bars upward and flat against the vertical adjustment bars for easy storage of the ladder and ladder safety accessory kit Locking means are located on proximal ends of the stabilizer bars. The locking means engage apertures located on the vertical adjustment bars, thereby allowing a user to lock the stabilizer bars at a desired height. The vertical adjustment bars may be permanently attached to a ladder via an attachment means, such as screws, nuts and bolts, welding, rivets, etc., or by other attachment means, such as one or more tubular members. One end of the at least one tubular member is permanently attached to the vertical adjustment bars and the opposite end is placed through a hollow rung of the ladder. The tubular members may be further secured to the ladder via at least one pin, which passes through the rung of the ladder and the tubular member, and/or by a cross member that extends through the length of the rung and engages a tubular member on either side of the ladder.

The lower stabilizer assembly is located on the lower portion of the ladder. Lower vertical adjustment bars are located on both sides of the ladder. Legs are slidably attached to the lower vertical adjustment bars, thereby allowing a user to adjust the length of the legs. Locking means engage apertures located on the lower vertical adjustment bars, thereby allowing a user to lock the legs at a desired height. The lower vertical adjustment bars may be permanently attached to the ladder via an attachment means, such as screws, nuts and bolts, welding, rivets, etc., or by other attachment means, such as one or more tubular members. One end of the at least one tubular member is permanently attached to the lower vertical adjustment bars and the opposite end placed through a hollow rung of the ladder. The tubular members may be further secured to the ladder via at least one pin, which passes through the rung of the ladder and the tubular member, and/or by a cross member that extends through the length of the rung and engages a tubular member on either side of the ladder. Feet are pivotally attached to the legs via pivot points so the ladder can be angled in relation to the feet. The feet may also be folded upward flat against the legs and lower adjustment bars for easy storage of the ladder and ladder safety accessory kit.

A bolt and locking nut assembly secures the feet to the legs and may be used to lock the ladder at a specific angle in relation to the feet, thereby ensuring that the ladder will remain in a locked position when leaned against a structure. A spike is pivotally attached to the foot via a pivot point. The spike may be folded into the foot for storage or when the foot is being used on a hard surface. The spike may also be folded into a downward position so that the spike will dig into the ground, thereby preventing the foot from sliding backwards.

The storage tray is used for holding tools and other materials while performing work on the ladder and is attached to the upper stabilizer assembly between the stabilizer bars. The storage tray may be secured to the stabilizer assembly by an attachment means, such as nuts and bolts, clips, screws, etc. Storage cups in the storage tray may be used for storing items, such as nails, screws, etc. Storage holes in the storage tray may be used for storing tools, such as screwdrivers, paintbrushes, etc. Although the storage tray may be made of any rigid material, it is preferably made of a magnetized metal that will prevent tools and other items from easily falling from the storage tray.

A leveling measurement device is located on either side of the ladder preferably at eye level, thereby allowing a user to read the leveling measurement device while in a standing position. The leveling measurement device has a front cover and a rear cover hingedly attached to the base. A horizontal bubble level is located on an inner surface of the front cover and a vertical horizontal bubble is located on an inner surface of the rear cover. The horizontal bubble level is preferably horizontally positioned on the inner surface of the front cover so a user can determine if the ladder is level and the ladder is not overextended sideways. The vertical bubble level is preferably positioned on the inner surface of the rear cover at angle of approximately 14.5 degrees in relationship to the ground, thereby ensuring that the base of the ladder is positioned at the proper distance from the structure the ladder is leaning against. To use the leveling measurement device, a user first opens the level measurement device so that the front cover and rear cover form a ninety degree angle. Next, the user adjusts the distance between the base of the ladder and the structure so the ladder is being leaned against the structure so that the bubble in the vertical bubble level is located in-between the two indicator lines printed on the vertical bubble level. Finally, the user adjusts the sides of the ladder so that the bubble in the horizontal bubble level is located in-between the two indicator lines printed on the horizontal bubble level.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
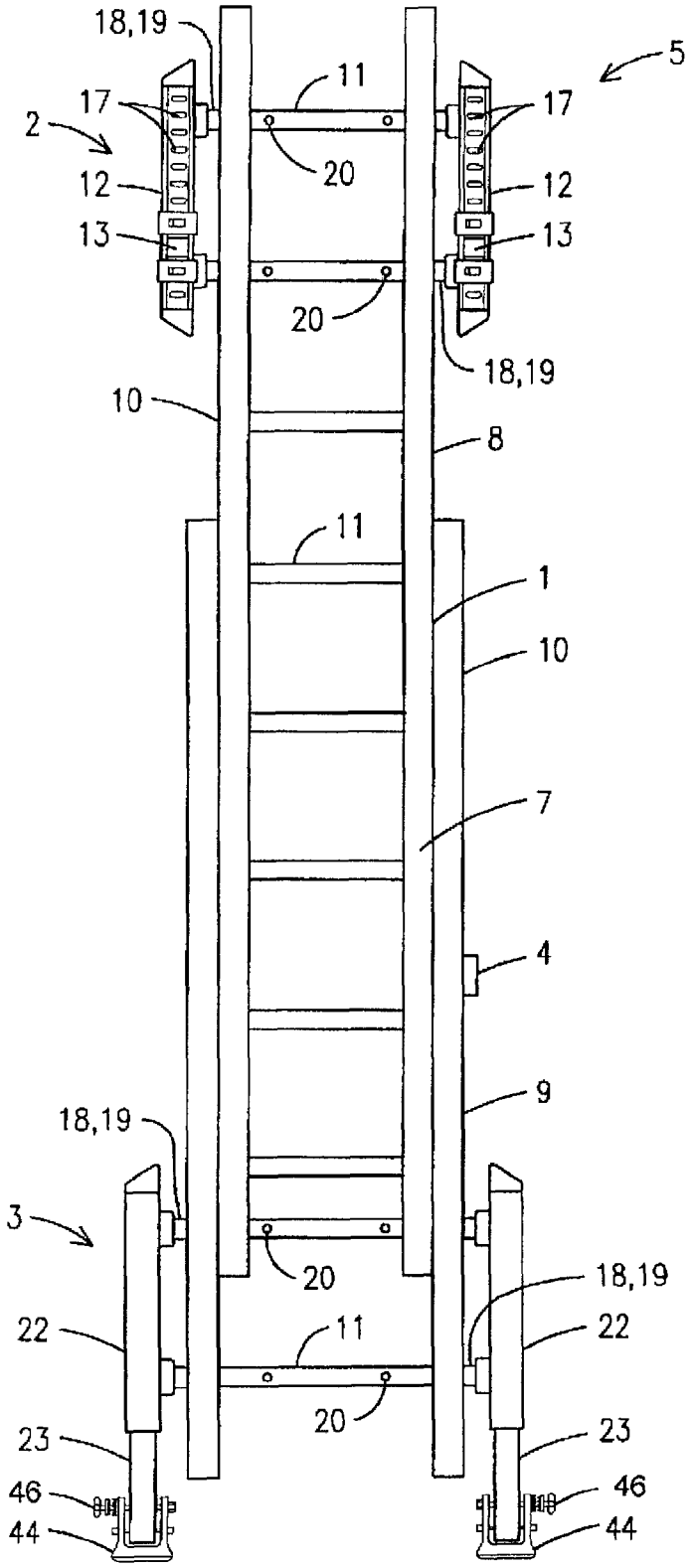
FIG. 1 is a rear view of a ladder having an upper stabilizer assembly, lower stabilizer assembly and a leveling measurement device of the present invention attached thereto.

For purposes of describing the preferred embodiment, the terminology used in reference to the numbered accessories in the drawings is as follows:

1. ladder
2. upper stabilizer assembly
3. lower stabilizer assembly
4. leveling measurement device
5. ladder safety accessory kit
6. front surface
7. rear surface
8. upper portion
9. lower portion
10. side
11. rung
12. upper vertical adjustment bar
13. stabilizer bar
14. proximal end of stabilizer bar
15. distal end of stabilizer bar
16. locking means
17. aperture
18. attachment means
19. tubular member
20. pin
21. cross member
22. lower vertical adjustment bar
23. leg
24. vertical slot
25. cap
26. base

Figure 5:
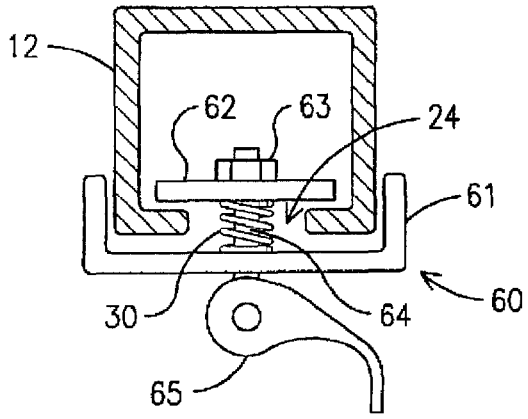
FIG. 5 is a cross sectional view of an upper vertical adjustment bar having a safety lock attached thereto.
Figure 6:
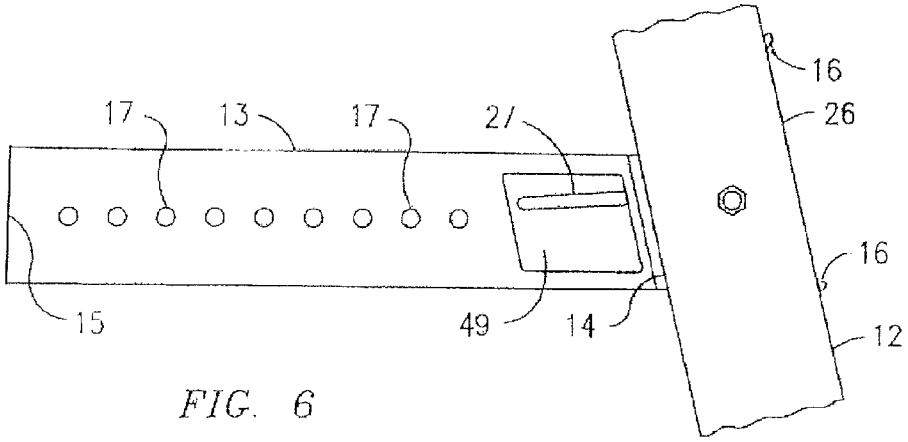
FIG. 6 is a partial cutaway side view of a stabilizer bar and sliding base of an upper stabilizer assembly.

27. trigger
28. lower lever
29. upper lever
30. spring
31. crossbar
32. cap
33. extension bar
34. V-shaped configuration
35. horizontal extension configuration
36. storage tray
37. storage cup
38. storage hole
39. tab
40. footer
41. flat portion
42. hook portion
43. non-skid material
44. foot
45. pivot point
46. bolt
47. 46*a*. locking washer
48. spike
49. opening
50. rear cover
51. front cover
52. horizontal bubble level
53. inner surface of cover
54. vertical bubble level
55. inner surface of base
56. screw
57. double sided tape
58. curved slot
59. flat surface
60. safety lock
61. upper plate
62. lower plate
63. nut
64. bolt
65. lever
66. eave
67. house
68. window
69. pole
70. clip With reference to FIGS. 1 and 2, rear and side views of a ladder 1 having an upper stabilizer assembly 2, lower stabilizer assembly 3 and a leveling measurement device 4 of a ladder safety accessory kit 5 attached thereto is shown. The ladder 1 has a front surface 6 that a user climbs, a rear surface 7 that faces a structure, an upper portion 8 that rests against a structure, a lower portion 9 that rests on the ground, sides 10, and a plurality of rungs 11 in-between the sides 10. The upper stabilizer assembly 2 is located on the upper portion 8 of the ladder 1 and has upper vertical adjustment bars 12 are located on both sides 10 of the ladder 1. Stabilizer bars 13 having proximal ends 14 and distal ends 15 are slidably attached to the upper vertical adjustment bars 12, thereby allowing a user to adjust the position of the stabilizer bars 13. The stabilizer bars 13 are also pivotally attached to the upper vertical adjustment bars 12, thereby allowing a user to fold the stabilizer bars 13 upward and flat against the upper vertical adjustment bars 12, thereby allowing for easy storage of the ladder 1 and ladder safety accessory kit 5. Locking means 16, as shown in FIGS. 5 and 6, are located on proximal ends 14 of the stabilizer bars 13. The locking means 16 engage apertures 17 located on the upper vertical adjustment bars 12, thereby allowing a user to lock the each stabilizer bar 13 at a desired height. The upper vertical adjustment bars 12 may be permanently attached to the ladder 1 via an attachment means 18, such as screws, nuts and bolts, welding, rivets, etc., or by other attachment means 18, such as at least one tubular member 19. Tubular members 19 are permanently attached to the upper vertical adjustment bars 12 and the tubular members 19 are placed through rungs 11 of the ladder 1, thereby securing the upper vertical adjustment bars 12 to the ladder 1. The at least one tubular member 19 may be further secured to the ladder 1 via at least one pin 20 which passes through the rung 11 the at least one tubular member 19 and/or by a cross member 21, as shown in FIG. 3, that extends through the length of the rung 11 and engages the at least one tubular member 19 on both sides 10 of the ladder 1.

Figure 14:
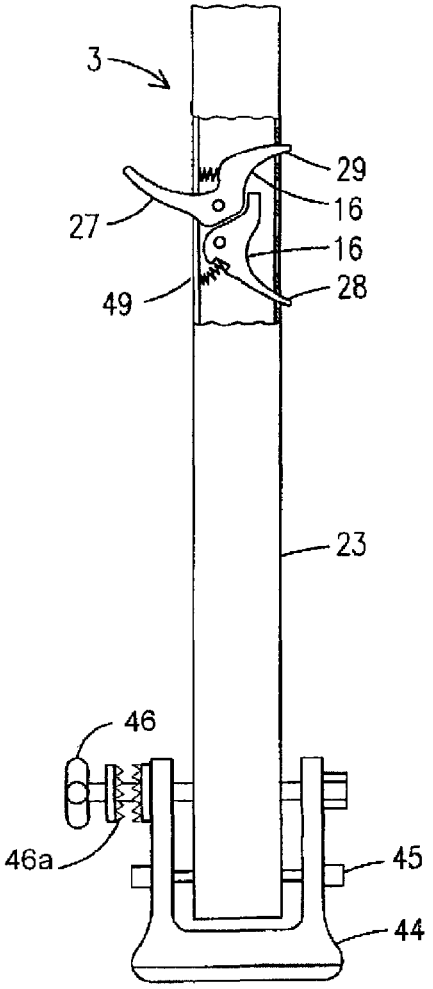
FIG. 14 is a front partial cross sectional view of a leg and foot of the present invention.
Figure 13:
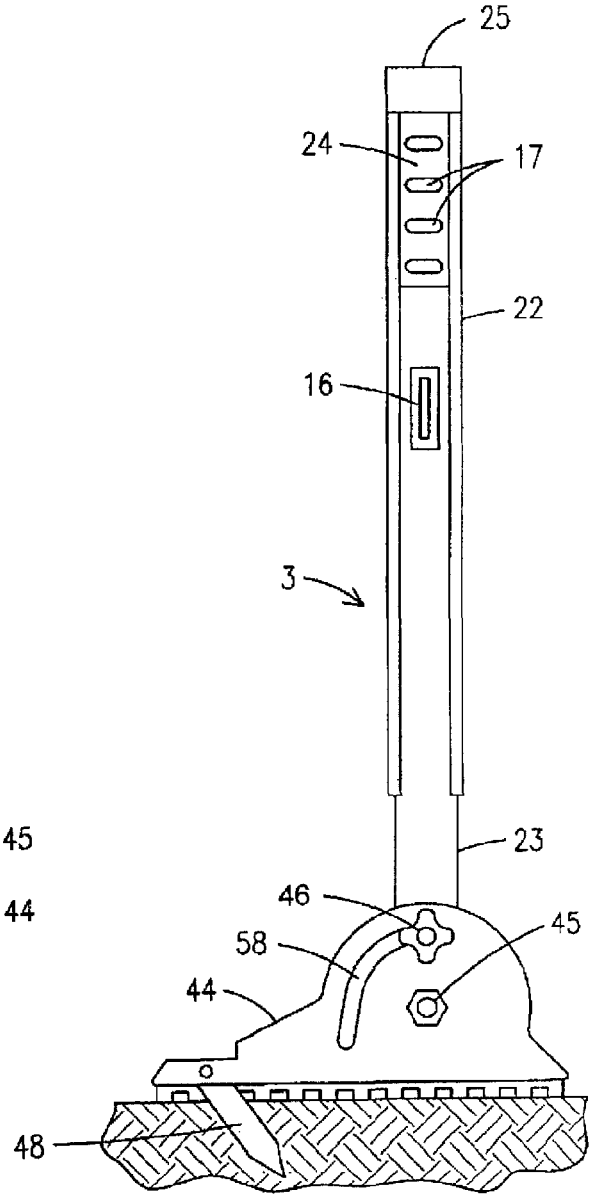
FIG. 13 is a side view of a lower stabilizer assembly of the present invention.

The lower stabilizer assembly 3 is located on the lower portion 9 of the ladder 1. lower vertical adjustment bars 22 are located on both sides 10 of the ladder 1. Legs 23 are slidably attached to the lower vertical adjustment bars 22, thereby allowing a user to adjust the sides 10 of the ladder 1 to accommodate an uneven ground. Feet 44 are pivotally attached to the bottom of the legs 23, thereby allowing legs 23 to be angled in relation to the feet 44, as shown further in FIG. 2. Bolts 46 secure the feet 44 to the legs 23 and are used to lock the legs 23 at desired angles in relation to the feet 44, thereby ensuring that the ladder 1 will remain in a locked position when leaned against a structure. Locking means 16, as shown in FIG. 13, are located in the legs 23. The locking means 16 engage apertures 17 located on the lower vertical adjustment bars 22, thereby allowing a user to lock the legs 23 at a desired height. The lower vertical adjustment bars 22 may be permanently attached to the ladder 1 via an attachment means 18, such as screws, nuts and bolts, welding, rivets, etc., or by other attachment means 18, such as at least one tubular member 19. One end of the at least one tubular member 19 is permanently attached to an lower vertical adjustment bar 22 and the opposite end of the tubular member 19 is placed through a rung 11 of the ladder 1. The at least one tubular member 19 may be further secured to the ladder 1 via at least one pin 20 which passes through the rung 11 the at least one tubular member 19 and/or by a cross member 21, as shown in FIG. 14, that extends through the length of the rung 11 and engages the at least one tubular member 19 on both sides 10 of the ladder 1.

Figure 15:
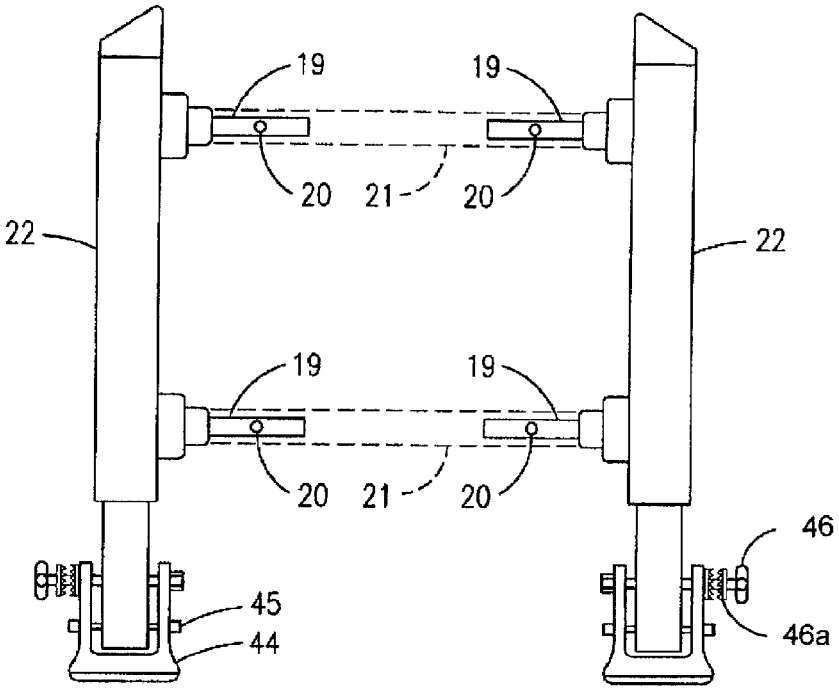
FIG. 15 is a front plan view of two lower vertical adjustment bars secured together by cross members.
Figure 16:
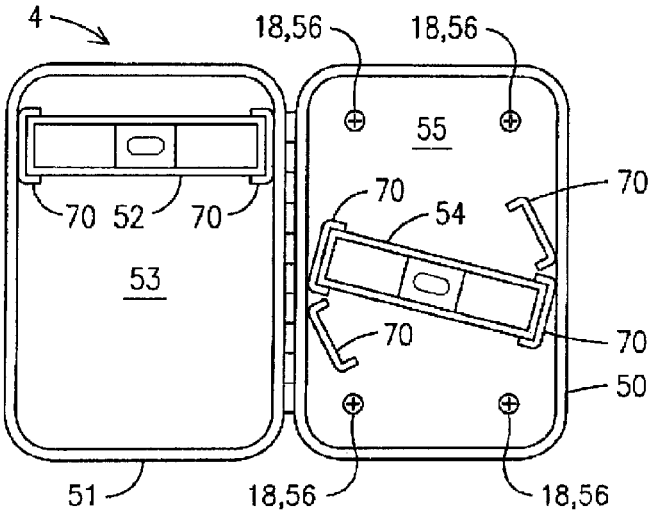
FIG. 16 is an inside view of a leveling measurement device in a fully open position.

The leveling measurement 4 device, as shown in more detail in FIGS. 15 and 16, may be located on either side 10 of the ladder 1 preferably at eye level, thereby allowing a user to read the leveling measurement device 4 while in a standing position.

Figure 2:
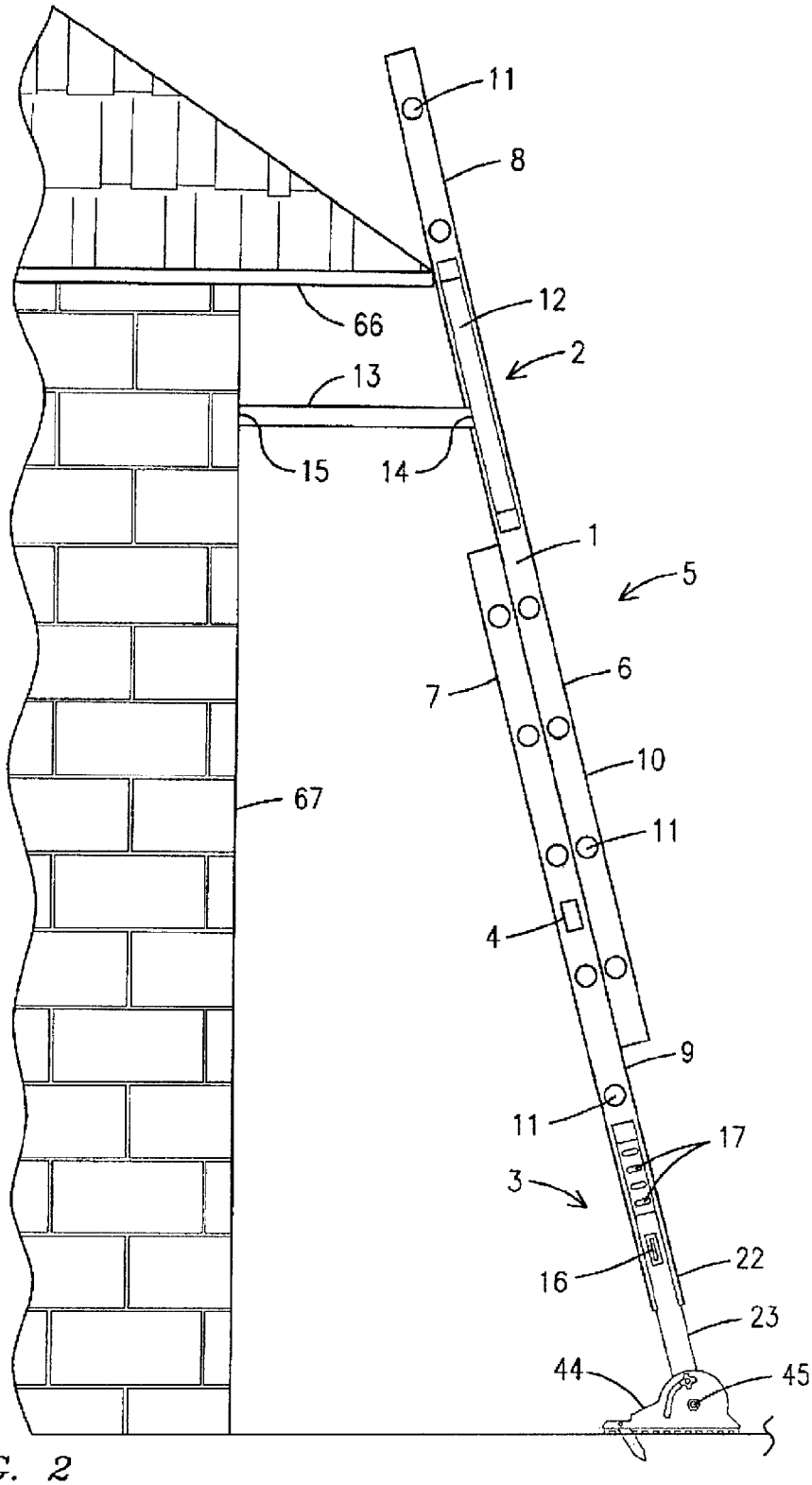
FIG. 2 is a side view of a ladder having an upper stabilizer assembly, lower stabilizer assembly and a leveling measurement device of a ladder safety accessory kit attached thereto.
Figure 3:
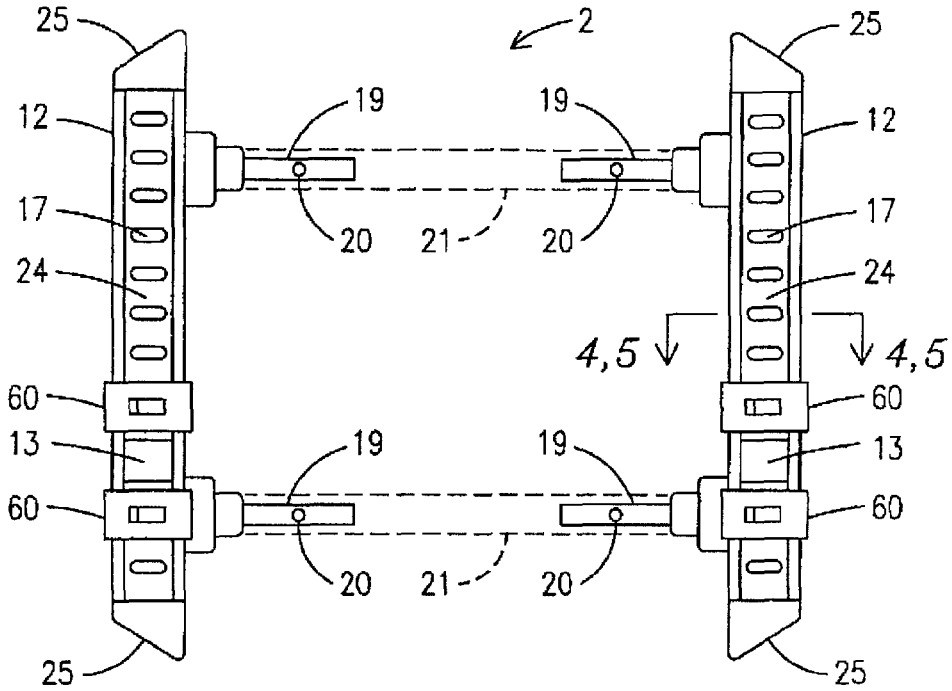
FIG. 3 is a front plan view of two upper vertical adjustment bars secured together by tubular members and cross members.

With reference to FIG. 2, a side view of a ladder 1 having an upper stabilizer assembly 2, lower stabilizer assembly 3 and a leveling measurement device 4 of a ladder safety accessory kit 5 attached thereto is shown. The ladder 1 has a front surface 6 that a user climbs, a rear surface 7 that faces a structure, an upper portion 8 that rests against a structure, a lower portion 9 that rests on the ground, sides 10, and a plurality of rungs 11 in-between the sides 10. The upper stabilizer assembly 2 is located on the upper portion 8 of the ladder 1. The upper vertical adjustment bars 12 are located on both sides 10 of the ladder 1. Stabilizer bars 13 having proximal ends 14 and distal ends 15 are slidably attached to the upper vertical adjustment bars 12, thereby allowing a user to adjust the position of the stabilizer bars 13 in relation to a structure. As shown here, the height of the stabilizer bars 13 are adjusted so that they fit securely underneath the eave 66 of a house 67, thereby further securing the ladder 1 in place. The stabilizer bars 13 are also pivotally attached to the upper vertical adjustment bars 12, thereby allowing a user to fold the stabilizer bars 13 upward and flat against the upper vertical adjustment bars 12, thereby allowing for easy storage of the ladder 1 and ladder safety accessory kit 5.

The lower stabilizer assembly 3 is located on the lower portion 9 of the ladder 1. lower vertical adjustment bars 22 are located on both sides 10 of the ladder 1. Legs 23 are slidably attached to the lower vertical adjustment bars 22, thereby allowing a user to adjust the sides 10 of the ladder 1 to accommodate an uneven ground. A foot 44 is pivotally attached to the bottom of the leg 23, thereby allowing leg 23 to be angled in relation to the foot 44, as shown further in FIG. 2. A bolt 45 secures the foot 44 to the leg 23 and is used to lock the leg 23 at a desired angle in relation to the foot 44, thereby ensuring that the ladder 1 will remain in a locked position when leaned against a structure. Locking means 16, as shown in FIG. 13, are located in the legs 23. The locking means 16 engage apertures 17 located on the lower vertical adjustment bars 22, thereby allowing a user to lock the legs 23 at a desired height. The lower stabilizer assembly 3 allows a user to easily move the ladder 1 across the length of a house 67 without having to readjust the stabilizer bars 13 in relation to the eave 66 of the house 67. For example, a user may simply lower the height of the ladder 1 using the lower stabilizer assembly 3, thereby disengaging the stabilizer bars 13 from the eave 66 of the house 67, and move the ladder 1 over. Then, the user may simply raise the height of the ladder 1 using the lower stabilizer assembly 3, thereby re-engaging the stabilizer bars 13 to the cave 66 of the house 67

The leveling measurement 4 device, as shown in more detail FIGS. 15 and 16, may be located on either side 10 of the ladder 1 preferably at eye level, thereby allowing a user to read the leveling measurement device 4 while in a standing position.

With reference to FIG. 3, a front plan view of two upper vertical adjustment bars 12 secured together by tubular members 19 and cross members 21 is shown. Each upper vertical adjustment bar 12 is substantially tubular shaped with a vertical slot 24 running the length of the upper vertical adjustment bar 12, as shown further in FIG. 4. The substantially tubular shape and vertical slot 24 allow for a stabilizer bar 13 to be slidably attached to the upper vertical adjustment bar 12. A plurality of apertures 17 are located on the upper vertical adjustment bars 12. The apertures 17 are used in conjunction with a locking means 16, as shown in FIGS. 5 and 6, for securing the stabilizer bars 13 at desired heights. The stabilizer bars 13 may be adjusted to different heights to accommodate for securing a ladder to a slanted roof and other surfaces. Caps 25 are located on either end of the upper vertical adjustment bars 12 to prevent the stabilizer bars 13 from sliding too far up or down and becoming disengaged from the upper vertical adjustment bars 12. Tubular members 19 for attaching the upper vertical adjustment bar 12 to a ladder 1 are attached to the upper vertical adjustment bars 12. The tubular members 19 are placed through rungs 11 of the ladder 1. The tubular members 19 may be further secured to the ladder 1 with pins 20 that pass through the rungs 11 and the tubular members 19. The tubular members 19 may also be further secured to the ladder 1 by cross members 21 that extend through the length of the rungs 11 and engage the tubular members 19. The cross members 21 are preferably similarly shaped to the tubular members 19 and are only slightly larger diameter wise than the tubular members 19, thereby allowing for a secure fit between the tubular members 19 and the cross members 21. Safety locks 60, as shown further in FIG. 5, are located above and below the stabilizer bars 13.

Figure 4:
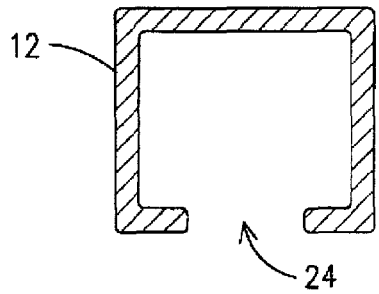
FIG. 4 is a cross sectional view of an upper vertical adjustment bar.

With reference to FIG. 4, a cross sectional view of an upper vertical adjustment bar 12 is shown. The upper vertical adjustment bar 12 is substantially tubular shaped with a vertical slot 24 running the length of the upper vertical adjustment bar 12. The substantially tubular shape and vertical slot 24 allow for a stabilizer bar 13 to be slidably attached to the upper vertical adjustment bar 12, as shown previously in FIG. 3.

With reference to FIG. 5, a cross sectional view of an upper vertical adjustment bar 12 having a safety lock 60 attached thereto is shown. The safety lock 60 has an upper plate 61 and a lower plate 62 secured together by a nut 63 and bolt 64. The safety lock 60 is placed in a vertical slot 24 of an upper vertical adjustment bar 12. A lever 65 secured to one end of the bolt 64 pulls the upper plate 61 and lower plate 62 together when in a locked position, thereby sandwiching the the edges of the vertical slot 24 and locking the safety lock 60 in place on the vertical adjustment bar 12. A spring 30 located between the upper plate 61 and lower plate 62 keep the upper plate 61 and a lower plate 62 separated when the lever 65 is in an unlocked position.

With reference to FIG. 6, a side view of a stabilizer bar 13 and sliding base 26 of an upper stabilizer assembly 2 is shown. The stabilizer bar 13 has a proximal end 14 and a distal end 15. The stabilizer bar 13 is pivotally attached at the proximal end 14 to the base 26, thereby allowing the stabilizer bar 13 to be folded upward. The base 26 fits inside an upper vertical adjustment bar 12, as shown previously in FIG. 3. When the base 26 is placed inside the upper vertical adjustment bar 12, the stabilizer bar 13 extends through a vertical slot 24 located in the upper vertical adjustment bar 12, as shown previously in FIG. 3. Apertures 17 located on the stabilizer bar 13 allow a user to attach various accessories to the stabilizer bar. A locking means 16 having a trigger 27 located in the proximal end 14 of the stabilizer bar and the base 26 is accessible through an opening 49 on the stabilizer bar 13.

Figure 7:
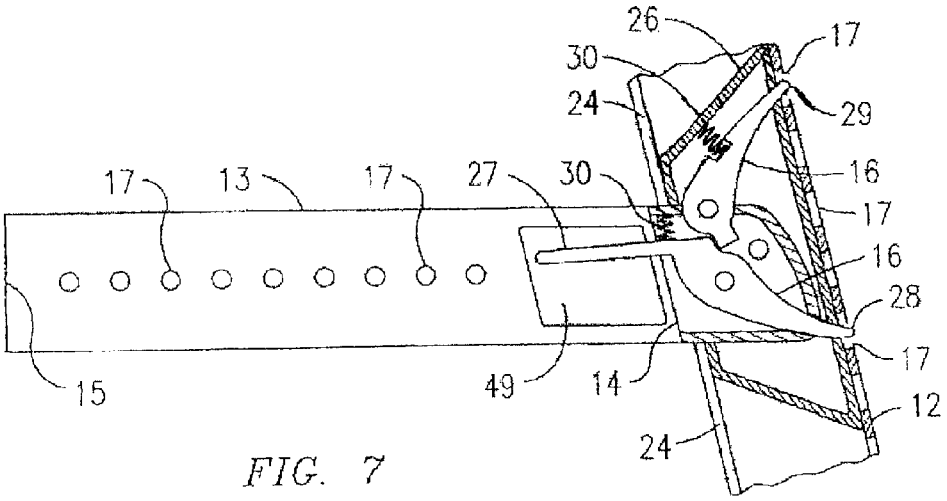
FIG. 7 is a top view of a ladder having an upper stabilizer assembly with a cross bar attached thereto.

With reference to FIG. 7, a partial cutaway side view of a stabilizer bar 13 and sliding base 26 of an upper stabilizer assembly 2 is shown. The stabilizer bar 13 has a proximal end 14 and a distal end 15. The stabilizer bar 13 is pivotally attached at the proximal end 14 to the base 26, thereby allowing the stabilizer bar 13 to be folded upward. The base 26 fits inside an upper vertical adjustment bar 12, as shown previously in FIG. 3. When the base 26 is placed inside the upper vertical adjustment bar 12, the stabilizer bar 13 extends through a vertical slot 24 located in the upper vertical adjustment bar 12, as shown previously in FIG. 3. Apertures 17 located on the stabilizer bar 13 allow a user to attach various accessories to the stabilizer bar. A locking means 16 having a trigger 27 located in the proximal end 14 of the stabilizer bar and the base 26 is accessible through an opening 49 on the stabilizer bar 13. The locking means 16 has a lower lever 28 and an upper lever 29 both pivotally attached to the sliding base 26. Springs 30 keep the upper lever 29 and lower lever 28 in a locked position so that the upper lever 29 and lower lever 28 are both engaged in the at least one aperture 17 of the upper vertical adjustment bar 12. By pushing upward on the trigger 27, pressure is applied to the springs 30 and the upper lever 29 is moved in an angled upward direction away from and out of the at least one aperture 17 and the lower lever 28 is moved in a angled downward direction away from and out of the at least one aperture 17.

Figure 8:
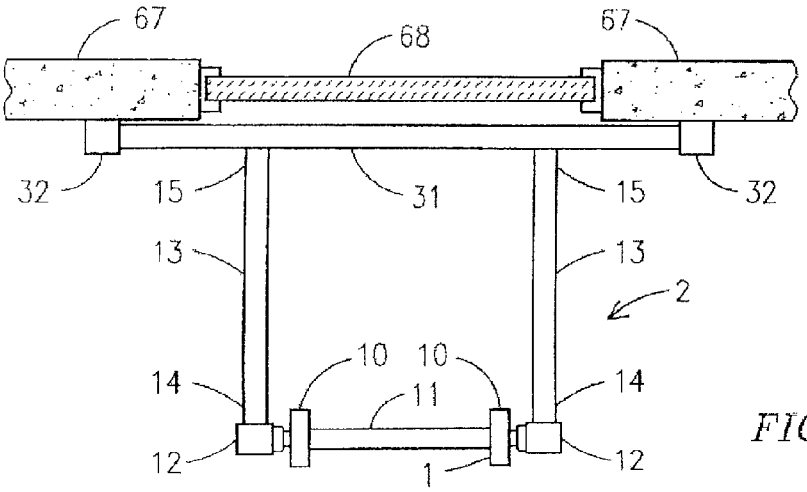
FIG. 8 is a top view of a ladder having an upper stabilizer assembly with extension bars forming a V-shaped configuration attached thereto.

With reference to FIG. 8, a top view of a ladder 1 having an upper stabilizer assembly 2 with a cross bar 31 attached thereto is shown. Upper vertical adjustment bars 12 are located on both sides 10 of the ladder 1. Proximal ends 14 of stabilizer bars 13 are slidably attached to the upper vertical adjustment bars 12, thereby allowing a user to adjust the position of the stabilizer bars 13. The cross bar 31 is attached to distal ends 15 of the stabilizer bars 13. The cross bar 31 allows a user to safely lean the ladder 1 against a house 67 without having to lean the ladder 1 directly on a window 68. Caps 32 made of non-skid material are located on both ends of the cross bar 31.

Figure 9:
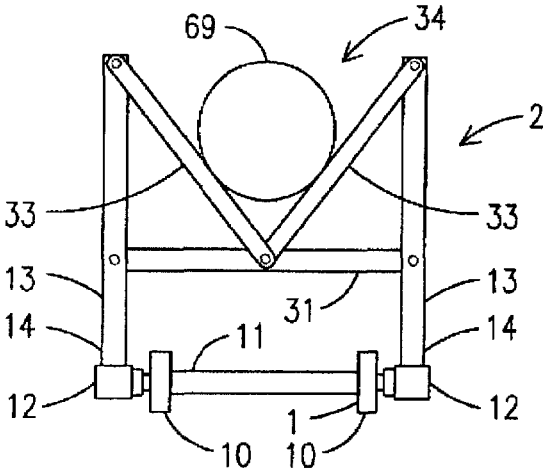
FIG. 9 is a top view of a ladder having an upper stabilizer assembly with extension bars forming a V-shaped configuration attached thereto.

With reference to FIG. 9, a top view of a ladder 1 having an upper stabilizer assembly 2 with extension bars 33 forming a V-shaped configuration 34 attached thereto is shown. Upper vertical adjustment bars 12 are located on both sides 10 of the ladder 1. Proximal ends 14 of stabilizer bars 13 are slidably attached to the upper vertical adjustment bars 12, thereby allowing a user to adjust the position of the stabilizer bars 13. The extension bars 33 are pivotally attached to distal ends 15 of the stabilizer bars 13, thereby allowing the extension bars 33 to be configured in different shapes depending on what type of structure the ladder 1 is being placed against. Here, the extension bars 33 are folded inward, thereby creating a V-shape configuration 34. The V-shape configuration 34 allows a user to safely lean the ladder 1 against structures, such as poles 69 and corners. A cross bar 31 attached to both stabilizer bars 13 and extension bars 33 adds extra strength to the upper stabilizer bar assembly 2 when it is placed against a structure.

Figure 10:
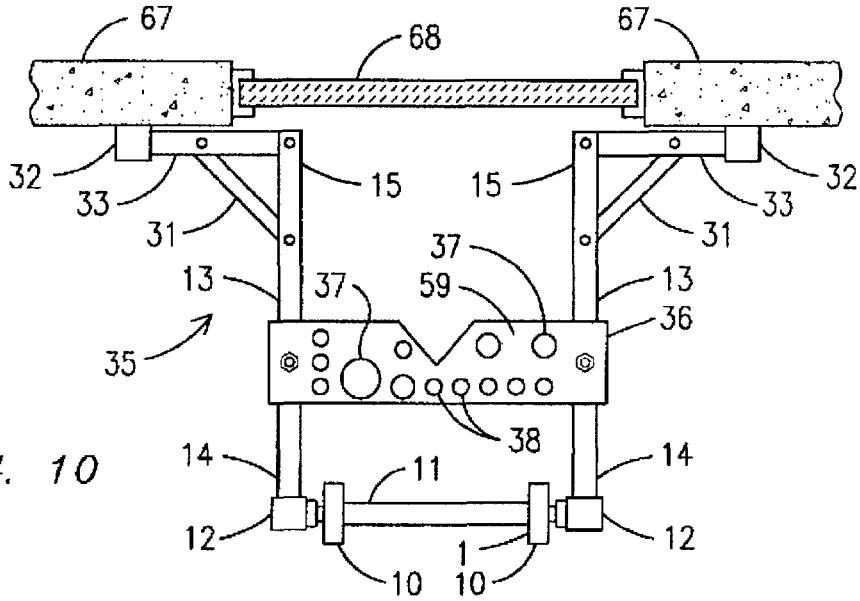
FIG. 10 is a top view of a ladder having an stabilizer bar assembly with extension bars attached thereto forming a horizontal extension configuration.

With reference to FIG. 10, a top view of a ladder 1 having a stabilizer bar assembly 2 with extension bars 33 attached thereto forming a horizontal extension configuration 35 is shown. Upper vertical adjustment bars 12 are located on both sides 10 of the ladder 1. Proximal ends 14 of stabilizer bars 13 are slidably attached to the upper vertical adjustment bars 12, thereby allowing a user to adjust the position of the stabilizer bars 13. The extension bars 33 are pivotally attached to distal ends 15 of the stabilizer bars 13, thereby allowing the extension bars 33 to be configured in different shapes depending on what type of structure the ladder 1 is being placed against. Here, the extension bars 33 are folded outward, thereby creating ninety degree angles with the stabilizer bars 13. This horizontal extension configuration 35 allows a user to safely lean the ladder 1 against a house 67 without having to lean the ladder 1 directly on a window 68. Cross bars 31 attached to both the stabilizing bars 13 and the extension bars 33 add extra strength to the upper stabilizer bar assembly 2 when it is placed against a structure. A storage tray 36 having a flat surface 59 for holding tools and other materials while performing work on the ladder 1 is attached to the upper stabilizer assembly 2 between the stabilizer bars 13. Storage cups 37 located in the in the storage tray 36 may be used for storing items, such as nails, screws and so forth. Storage holes 38 located in the in the storage tray 36 may be used for storing tools, such as screwdrivers, paintbrushes and so forth. Although the storage tray 36 may be made of any rigid material, it is preferably mad of a magnetized metal that will prevent tools and other items from easily falling from the storage tray 36.

Figure 11:
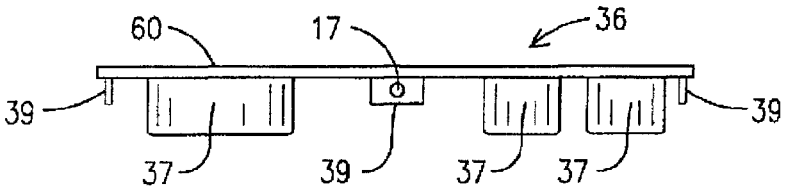
FIG. 11 is a front view of a storage tray of the present invention.

With reference to FIG. 11, a front view of a storage tray 36 of the present invention is shown. The storage tray 36 is used for holding tools and other materials while performing work on a ladder 1 and may be attached to an upper stabilizer assembly 2 between the stabilizer bars 13, as previously shown in FIG. 9, or directly to a ladder using attachment means 18, such as screws, nuts and bolts, welding, rivets, clips, etc. As shown here, the storage tray has a plurality of tabs 39 extending downward for the storage tray 36. The tabs 39 have apertures 17 for receiving attachment means 18, such as bolts, screws, etc., for attaching the storage tray 36 to the upper stabilizer assembly 2. The storage tray 36 has a flat surface 60 with storage cups 37 located in the in the storage tray 36 may be used for storing items, such as nails, screws and so forth. Storage holes 38, as shown previously in FIG. 10, located in the in the storage tray 36 may be used for storing tools, such as screwdrivers, paintbrushes and so forth.

Figure 12:
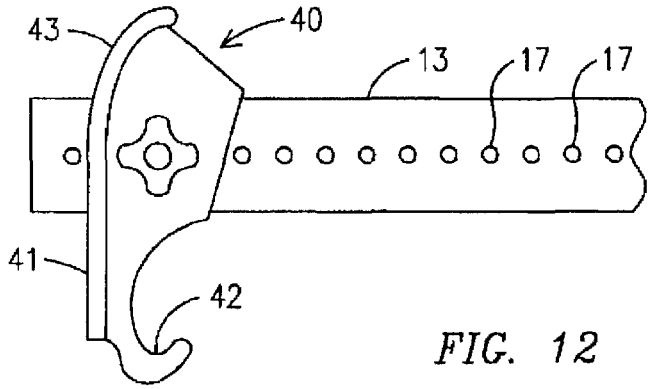
FIG. 12 is a side view of a stabilizer bar having a footer of the present invention attached thereto.

With reference to FIG. 12, a side view of a stabilizer bar 13 having a footer 40 of the present invention attached thereto is shown. The footer 40 has a flat portion 41 and a hook portion 42 and is slidably attached to the stabilizer bar 13 having at least one aperture 17. A locking means 16, such as a bolt, cotter pin etc., engages the at least one aperture, thereby locking the footer 40 in a desired position. The flat portion 41 may have an outer layer non-skid material 43, such as rubber, to prevent slipping. The footer 40 may be placed on the stabilizer bar 13 with the flat portion 41 facing toward a ladder 1 or the hook portion 42 facing toward a ladder 1. For example, the footer 40 may be placed on the stabilizer bar 13 with the hooked portion 42 facing the ladder 1, thereby allowing a user to hook the footer 40 over power lines or other elevated cables to prevent the ladder 1 from tilting backwards while in use. Alternatively, the footer 40 may be placed on the stabilizer bar 13 with the flat portion 41 facing the ladder 2, thereby allowing a user to lock the ladder 2 against the top of a wall.

With reference to FIG. 13, a side view of a lower stabilizer assembly 3 of the present invention is shown. A lower vertical adjustment bar 22 is substantially tubular shaped with a vertical slot 24 running the length of the lower vertical adjustment bar 22. The substantially tubular shape and vertical slot 24 allow a leg 23 to be slidably attached to the lower vertical adjustment bar 22. A plurality of apertures 17 are located on the lower vertical adjustment bar 22. The apertures 17 are used in conjunction with a locking means 16 to adjust and secure the leg 23 to a desired height. A cap 25 located on the top of the lower vertical adjustment bar 22 prevents the leg 23 from sliding too far up the lower vertical adjustment bar 22. A foot 44 is pivotally attached to the bottom of the leg 23 via a pivot point 45, thereby allowing leg 23 to be angled in relation to the foot 44. A bolt 46 secures the foot 44 to the leg 23 through a curved slot 58 that allows a user to lock the leg 23 at a desired angle in relation to the foot 44, thereby ensuring that a ladder 1 will remain in a locked position when leaned against a structure, as shown previously in FIG. 2. A spike 48 is pivotally attached to the foot 44. The spike 48 may be folded into the foot 44 for storage or when the foot 44 is being used on a hard surface. The spike 48 may be folded down, as shown here, when the foot is being used on soft ground so that the spike 48 will dig into the ground, thereby preventing the foot 44 from sliding backwards.

With reference to FIG. 14, a front partial cross sectional view of a leg 23 and foot 44 of the present invention is shown. The foot 44 is pivotally attached to the bottom of the leg 23 via a pivot point 45, thereby allowing leg 23 to be angled in relation to the foot 44. A bolt 46 and locking washer **46*a* secure the foot 44 to the leg 23 and are used to lock the leg 23 at a desired angle in relation to the foot 44, thereby ensuring that a ladder 1 will remain in a locked position when leaned against a structure, as shown previously in FIG. 2. A locking means 16 having a trigger 27 located in the leg 23 extends out of an opening 49 of the leg 23. The locking means 16 has a lower lever 28 and an upper lever 29 both pivotally attached to the leg 23. Springs 30 keep the upper lever 28 and lower lever 29 in a locked position so that the upper lever 28 and lower lever 29 are both engaged in an at the at least one aperture 17 of the lower vertical adjustment bar 12**.

With reference to FIG. 15, a front plan view of two lower vertical adjustment bars 22 secured together by cross members 21 is shown. Tubular members 19 for attaching the upper vertical adjustment bar 12 to a ladder 1 are attached to the lower vertical adjustment bars 22. The tubular members 19 are placed through rungs 11 of the ladder 1. The tubular members 19 may be further secured to the ladder 1 with pins 20 that pass through the rungs 11 the tubular members 19 and/or by cross members 21 that extend through the length of the rungs 11 and engage the tubular members 19. The cross members 21 are preferably similarly shaped to the tubular members 19 and are only slightly larger diameter wise than the tubular members 19, thereby allowing for a secure fit between the tubular members 19 and the cross members 21.

With reference to FIG. 16, an inside view of a leveling measurement device 4 in a fully open position is shown. The leveling measurement device 4 has a rear cover 50 and a front cover 51 hingedly attached to each other. A horizontal bubble level 52 is located on an inner surface 53 of the front cover 51 and a vertical bubble level 54 located on an inner surface 55 of the rear cover 50. The horizontal bubble level 52 is preferably horizontally positioned on the inner surface 53 of the front cover 51 so a user can determine if a ladder 1 is level and the ladder 1 is not leaning sideways. The vertical bubble level 54 is preferably positioned on the inner surface 55 of the rear cover 50 at an angle of approximately 14.5 degrees in relationship to the ground so a user can determine if a lower portion 9 of a ladder 1 is positioned at the proper distance from the structure the ladder 1 is leaning against. The leveling measurement device 4 may be attached to a ladder 1, as shown in FIG. 1, via an attachment means 18, such as screws 56, double sided tape, a hook and loop fastener, etc. The leveling measurement device 4 is preferably attached to a ladder 1 so that the leveling measurement device 4 is at eye level. Clips 70 for securing the vertical bubble level 54 to the inner surface 55 of the rear cover 50 are provided. The clips 70 allow a user position the vertical bubble level 54 at the proper angle depending on which side of a ladder 1 the leveling measurement device 4 is being attached to. To use the leveling measurement device 4, a user first opens the level measurement device 4 so that the front cover 51 and rear cover 50 form a ninety degree angle. Then the user adjusts the sides 10 of the ladder 1 so that the bubble in the horizontal bubble level 52 is located in-between the two indicator lines printed on the horizontal bubble level. Next, the user adjusts the distance between the lower portion 9 of the ladder 1 and the structure the ladder 1 is being leaned against so that the bubble in the vertical bubble level 54 is located in-between the two indicator lines printed on the vertical bubble level 54. The vertical bubble levels 52, 54 may be filled with a liquid that glows in the dark, thereby allowing a user to see the bubble levels 52, 54 to be seen in the dark.

Figure 17:
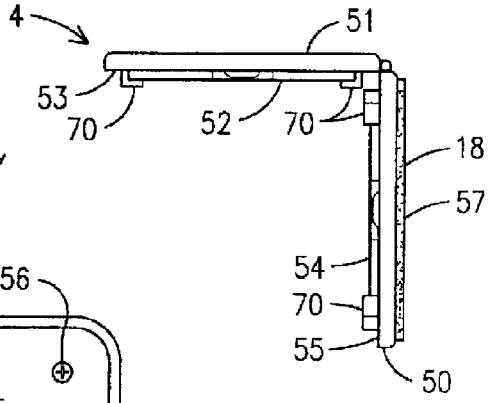
FIG. 17 is a top view of a leveling measurement device in a partially open position.

Finally with reference to FIG. 17, a top view of a leveling measurement device 4 in a partially open position is shown. The leveling measurement device 4 has a rear cover 50 and a front cover 51 hingedly attached to each other. A horizontal bubble level 52 is located on an inner surface 53 of the front cover 51 and a vertical bubble level 54 located on an inner surface 55 of the rear cover 50. The horizontal bubble level 52 is preferably horizontally positioned on the inner surface 53 of the front cover 51 so a user can determine if a ladder 1 is level and the ladder 1 is not leaning sideways. The vertical bubble level 54 is preferably positioned on the inner surface 55 of the rear cover 50 at an angle of approximately 14.5 degrees in relationship to the ground so a user can determine if a lower portion 9 of a ladder 1 is positioned at the proper distance from the structure the ladder 1 is leaning against. The leveling measurement device 4 may be attached to a ladder 1, as shown in FIG. 1, via an attachment means 18, such as screws, double sided tape 57, a hook and loop fastener, etc.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

Having thus described my invention, I claim:

1. A ladder safety accessory kit for a ladder having a front surface, a rear surface, an upper portion, a lower portion, sides and a plurality of rungs in-between the sides, said ladder safety accessory kit comprising:

an upper stabilizer assembly having a first upper vertical adjustment bar and a second upper vertical adjustment bar;

said first upper vertical adjustment bar and said second upper vertical adjustment bar each respectively having a vertical slot located thereon;

a first stabilizer bar having a proximal end and a distal end;

said proximal end of the first stabilizer bar extends into the vertical slot located on the first upper vertical adjustment bar and is held in a substantially perpendicular position in relation to the first upper vertical adjustment bar;

a second stabilizer bar having a proximal end and a distal end;

said proximal end of the second stabilizer bar extends into the vertical slot located on the second upper vertical adjustment bar and is held in a substantially perpendicular position in relation to the second upper vertical adjustment bar;

said first upper vertical adjustment bar having at least two substantially tubular-shaped members extending from a first side surface of a first side of the first upper vertical adjustment bar so that each of the at least two substantially tubular-shaped members extending from the first upper vertical adjustment bar are perpendicular to the first upper vertical adjustment bar, said at least two substantially tubular-shaped members extending from the first upper vertical adjustment bar are configured to allow a user to attach the first upper vertical adjustment bar to a first one of the sides of the ladder by inserting the at least two substantially tubular-shaped members extending from the first upper vertical adjustment bar into at least two of the plurality of rungs located on the ladder; and said second upper vertical adjustment bar having at least two substantially tubular-shaped members extending from a first side surface of a first side of the second upper vertical adjustment bar so that each of the at least two substantially tubular-shaped members extending from the second upper vertical adjustment bar are perpendicular to the second upper vertical adjustment bar, said at least two substantially tubular-shaped members extending from the second upper vertical adjustment bar are configured to allow a user to attach the second upper vertical adjustment bar to a second one of the sides of the ladder by inserting the substantially tubular-shaped members extending from the second upper vertical adjustment bar into the at least two of the plurality of rungs located on the ladder; and a first plurality of apertures located on a second side of the first upper vertical adjustment bar, wherein the vertical slot of the first upper vertical adjustment bar is located on a third side of the first upper vertical adjustment bar which is opposite from the second side of the first upper vertical adjustment bar; and a second plurality of apertures located on a second side of the second upper vertical adjustment bar, wherein the vertical slot of the second upper vertical adjustment bar is located on a third side of the second upper vertical adjustment bar which is opposite from the second side of the second upper vertical adjustment bar; and a first lower lever and a first upper lever located at the proximal end of the first stabilizer bar, said first lower lever and said first upper lever each respectively configured to engage one of the first plurality of apertures located on the first upper vertical adjustment bar to lock the first stabilizer bar with respect to the first upper vertical adjustment bar; and a second lower lever and a second upper lever located at the proximal end of the first stabilizer bar, said second lower lever and said second upper lever each respectively configured to engage one of the second plurality of apertures located on the second upper vertical adjustment bar to lock the second stabilizer bar with respect to the second upper vertical adjustment bar; and the lower levers respectively having a trigger, wherein the first lower lever and the first upper lever are respectively pivotally attached to the proximal end of the first stabilizer bar, the second lower lever and the second upper lever are respectively pivotally attached to the proximal end of the second stabilizer bar, the trigger of the first lower lever is configured to be lifted against a bias of a spring to directly cause the first lower lever and the first upper lever to respectively pivot out of engagement with each respective said one of the first plurality of apertures to unlock the first stabilizer bar with respect to the first upper vertical adjustment bar to allow the first stabilizer bar to slide within said first upper vertical adjustment bar while extending substantially perpendicularly away from said first upper vertical adjustment bar, the trigger of the second lower lever is configured to be lifted against a bias of a spring to directly cause the second lower lever and the second upper lever to respectively pivot out of engagement with each respective said one of the second plurality of apertures to unlock the second stabilizer bar with respect to the second upper vertical adjustment bar to allow the second stabilizer bar to slide within said second upper vertical adjustment bar while extending substantially perpendicularly away from said second upper vertical adjustment bar.

2. The ladder safety accessory kit of claim 1 wherein:

the first stabilizer bar is slidably attached to the first upper vertical adjustment bar; and the second stabilizer bar is slidably attached to the second upper vertical adjustment bar.

3. The ladder safety accessory kit of claim 1 wherein:

said first upper vertical adjustment bar is substantially tubular shaped; and said second upper vertical adjustment bar is substantially tubular shaped.

4. The ladder safety accessory kit of claim 1 wherein:

a base is located on the proximal end of the first stabilizer bar;

said base located on the proximal end of the first stabilizer bar is located within the first upper vertical adjustment bar in a manner in which the first stabilizer bar extends through the slot located on the first upper vertical adjustment bar;

a base is located on the proximal end of the second stabilizer bar; and said base located on the proximal end of the second stabilizer bar is located within the second upper vertical adjustment bar in a manner in which the second stabilizer bar extends through the slot located on the second upper vertical adjustment bar.

5. The ladder safety accessory kit of claim 2 further comprising:

a first safety lock located on the first upper vertical adjustment bar below the proximal end of the first stabilizer bar; and a second safety lock located on the second upper vertical adjustment bar below the proximal end of the second stabilizer bar.

6. The ladder safety accessory kit of claim 1 further comprising:

at least one crossbar attached to the first stabilizer bar and the second stabilizer bar.

7. The ladder safety accessory kit of claim 1 further comprising:

at least one pin for securing the two substantially tubular-shaped members attached to the first upper vertical adjustment bar within the at least two of the plurality of rungs located on the ladder; and at least one pin for securing the two substantially tubular-shaped members attached to the second upper vertical adjustment bar within the at least two of the plurality of rungs located on the ladder.

8. The ladder safety accessory kit of claim 1 further comprising:

at least one cap located on the first upper vertical adjustment bar; and at least one cap located on the second upper vertical adjustment bar.

9. The ladder safety accessory kit of claim 1 further comprising:

a lower stabilizer assembly having a first lower vertical adjustment bar and a second lower vertical adjustment bar;

a first leg that is slidably attached to the first lower vertical adjustment bar;

a first foot pivotally attached to the first leg;

a second leg that is slidably attached to the second lower vertical adjustment bar;

said first lower vertical adjustment bar having at least two substantially tubular-shaped members extending from a side surface of a first side of the first lower vertical adjustment bar so that each of the at least two substantially tubular-shaped members extending from the first lower vertical adjustment bar are perpendicular to the first lower vertical adjustment bar, said at least two substantially tubular-shaped members extending from the first lower vertical adjustment bar are configured to allow a user to attach the first lower vertical adjustment bar to the first one of the sides of the ladder by inserting the at least two substantially tubular-shaped members extending from the first lower vertical adjustment bar into at least two of the plurality of rungs located on the ladder; and said second lower vertical adjustment bar having at least two substantially tubular-shaped members extending from a side surface of a first side of the second lower vertical adjustment bar so that each of the at least two substantially tubular-shaped members extending from the second lower vertical adjustment bar are perpendicular to the second lower vertical adjustment bar, said at least two substantially tubular-shaped members extending from the second lower vertical adjustment bar are configured to allow a user to attach the second lower vertical adjustment bar to the second one of the sides of the ladder by inserting the substantially tubular-shaped members extending from the second lower vertical adjustment bar into at least two of the plurality of rungs located on the ladder.

10. The ladder safety accessory kit of claim 1 further comprising:

a leveling measurement device having a front cover hingedly attached to a rear cover;

said front cover having an upper edge, a lower edge and side edges;

said rear cover having an upper edge, a lower edge and side edges;

a horizontal bubble level attached to an inner surface of the front cover so that when the front cover is open at a ninety degree angle to the rear cover a user can determine if the ladder is leaning to a right or to a left;

said horizontal bubble level being parallel with the upper edge of the front cover;

a vertical bubble level attached to an inner surface of the rear cover;

said vertical bubble level being at an angle in relation to the upper edge of the rear cover; and an attachment means for attaching the rear cover to an outer side surface of the ladder so that a rear surface of the rear cover is parallel to the outer side surface of the ladder.

11. The ladder safety accessory kit of claim 10 wherein:

said vertical bubble level is filled with a liquid configured to glow in a dark area; and said horizontal bubble level is filled with a liquid configured to glow in the dark area.

12. The ladder safety accessory kit of claim 10 wherein:

said vertical bubble level is attached to the rear cover by at least one clip; and said horizontal bubble level is attached to the front cover by at least one clip.

13. A ladder safety accessory kit for a ladder having a front surface, a rear surface, an upper portion, a lower portion, sides and a plurality of rungs in-between the sides, said ladder safety accessory kit comprising:

a lower stabilizer assembly having a first lower vertical adjustment bar and a second lower vertical adjustment bar;

a first leg that is slidably attached to the first lower vertical adjustment bar;

a first foot pivotally attached to the first leg;

a second leg that is slidably attached to the second lower vertical adjustment bar;

a second foot pivotally attached to the second leg;

said first lower vertical adjustment bar having at least two substantially tubular-shaped members extending from a side surface of a first side of the first lower vertical adjustment bar so that each of the at least two substantially tubular-shaped members extending from the first lower vertical adjustment bar are perpendicular to the first lower vertical adjustment bar, said at least two substantially tubular-shaped members extending from the first lower vertical adjustment bar are configured to allow a user to attach the first lower vertical adjustment bar to a first one of the sides of the ladder by inserting the at least two substantially tubular-shaped members extending from the first lower vertical adjustment bar into at least two of the plurality of rungs located on the ladder; and said second lower vertical adjustment bar having at least two substantially tubular-shaped members extending from a side surface of a first side of the second lower vertical adjustment bar so that each of the at least two substantially tubular-shaped members extending from the second lower vertical adjustment bar are perpendicular to the second lower vertical adjustment bar, said at least two substantially tubular-shaped members extending from the second lower vertical adjustment bar are configured to allow a user to attach the second lower vertical adjustment bar to a second one of the sides of the ladder by inserting the substantially tubular-shaped members extending from the second lower vertical adjustment bar into the at least two of the plurality of rungs located on the ladder;

said first lower vertical adjustment bar is substantially tubular shaped;

a first vertical slot is located on the first lower vertical adjustment bar;

said second lower vertical adjustment bar is substantially tubular shaped;

a second vertical slot is located on the second lower vertical adjustment bar;

a first plurality of apertures located on the first side of the first lower vertical adjustment bar, wherein the first vertical slot is located on an opposite second side of the first lower vertical adjustment bar; and a second plurality of apertures located on the first side of the second lower vertical adjustment bar, wherein the second vertical slot is located on an opposite second side of the second lower vertical adjustment bar; and a first lower lever and a first upper lever located within the first leg, said first lower lever and said first upper lever each respectively configured to engage one of the first plurality of apertures located on the first lower vertical adjustment bar to lock the first leg with respect to the first lower vertical adjustment bar; and a second lower lever and a second upper lever located with the second leg, said second lower lever and said second upper lever each respectively configured to engage one of the second plurality of apertures located on the second lower vertical adjustment bar to lock the second leg with respect to the second upper vertical adjustment bar; and the upper levers respectively having a trigger, wherein the first lower lever and the first upper lever are respectively pivotally attached to the inside of the first leg, the second lower lever and the second upper lever are respectively pivotally attached to the inside of the second leg, the trigger of the first upper lever passes through the first vertical slot and is configured to be pushed downward against a bias of a spring to directly cause the first upper lever and the first lower lever to respectively pivot out of engagement with each respective said one of the first plurality of apertures to unlock the first leg with respect to the first lower vertical adjustment bar to allow the first leg to slide within said first lower vertical adjustment bar, the trigger of the second upper lever passes through the second vertical slot and is configured to be pushed downward against a bias of a spring to directly cause the second upper lever and the second lower lever to respectively pivot out of engagement with each respective said one of the second plurality of apertures to unlock the second leg with respect to the second lower vertical adjustment bar to allow the second leg to slide within said second upper vertical adjustment bar, and the first and second legs are configured to support the lower vertical adjustment bars along with the ladder above a ground surface while a user is on the ladder.

14. The ladder safety accessory kit of claim 13 further comprising:

at least one pin for securing the two substantially tubular-shaped members attached to the first lower vertical adjustment bar within the at least two of the plurality of rungs located on the ladder; and at least one pin for securing the two substantially tubular-shaped members attached to the second lower vertical adjustment bar within the at least two of the plurality of rungs located on the ladder.

15. The ladder safety accessory kit of claim 13 further comprising:

at least one cap located on the first lower vertical adjustment bar; and at least one cap located on the second lower vertical adjustment bar.

16. A ladder safety accessory kit for a ladder having a front surface, a rear surface, an upper portion, a lower portion, sides and a plurality of rungs in-between the sides, said ladder safety accessory kit comprising:

an upper stabilizer assembly having a first upper vertical adjustment bar and a second upper vertical adjustment bar;

said first upper vertical adjustment bar and said second upper vertical adjustment bar each respectively having a vertical slot located thereon;

a first stabilizer bar having a proximal end and a distal end, a first base is located on the proximal end of the first stabilizer bar and is located within the first upper vertical adjustment bar so that the first stabilizer bar extends into the vertical slot located on the first upper vertical adjustment bar and is held in a substantially perpendicular position in relation to the first upper vertical adjustment bar;

a second stabilizer bar having a proximal end and a distal end, a second base is located on the proximal end of the second stabilizer bar and is located within the second upper vertical adjustment bar so that the second stabilizer bar extends into the vertical slot located on the second upper vertical adjustment bar and is held in a substantially perpendicular position in relation to the second upper vertical adjustment bar;

said first upper vertical adjustment bar having at least two substantially tubular-shaped members extending from a first side surface of a first side of the first upper vertical adjustment bar so that each of the at least two substantially tubular-shaped members extending from the first upper vertical adjustment bar are perpendicular to the first upper vertical adjustment bar, said at least two substantially tubular-shaped members extending from the first upper vertical adjustment bar are configured to allow a user to attach the first upper vertical adjustment bar to a first one of the sides of the ladder by inserting the at least two substantially tubular-shaped members extending from the first upper vertical adjustment bar into at least two of the plurality of rungs located on the ladder; and said second upper vertical adjustment bar having at least two substantially tubular-shaped members extending from a first side surface of a first side of the second upper vertical adjustment bar so that each of the at least two substantially tubular-shaped members extending from the second upper vertical adjustment bar are perpendicular to the second upper vertical adjustment bar, said at least two substantially tubular-shaped members extending from the second upper vertical adjustment bar are configured to allow a user to attach the second upper vertical adjustment bar to a second one of the sides of the ladder by inserting the substantially tubular-shaped members extending from the second upper vertical adjustment bar into the at least two of the plurality of rungs located on the ladder; and a first plurality of apertures located on a second side of the first upper vertical adjustment bar, wherein the vertical slot of the first upper vertical adjustment bar is located on a third side of the first upper vertical adjustment bar which is opposite from the second side of the first upper vertical adjustment bar; and a second plurality of apertures located on a second side of the second upper vertical adjustment bar, wherein the vertical slot of the second upper vertical adjustment bar is located on a third side of the second upper vertical adjustment bar which is opposite from the second side of the second upper vertical adjustment bar; and a first lower lever and a first upper lever located at the proximal end of the first stabilizer bar, said first lower lever and said first upper lever each respectively configured to engage one of the first plurality of apertures located on the first upper vertical adjustment bar to lock the first stabilizer bar with respect to the first upper vertical adjustment bar; and a second lower lever and a second upper lever located at the proximal end of the first stabilizer bar, said second lower lever and said second upper lever each respectively configured to engage one of the second plurality of apertures located on the second upper vertical adjustment bar to lock the second stabilizer bar with respect to the second upper vertical adjustment bar; and the lower levers respectively having a trigger, wherein the first lower lever and the first upper lever are respectively pivotally attached to the proximal end of the first stabilizer bar, the second lower lever and the second upper lever are respectively pivotally attached to the proximal end of the second stabilizer bar, the trigger of the first lower lever is configured to be lifted against a bias of a spring to directly cause the first lower lever and the first upper lever to respectively pivot out of engagement with each respective said one of the first plurality of apertures to unlock the first stabilizer bar with respect to the first upper vertical adjustment bar to allow the first stabilizer bar to slide within said first upper vertical adjustment bar while extending substantially perpendicularly away from said first upper vertical adjustment bar, the trigger of the second lower lever is configured to be lifted against a bias of a spring to directly cause the second lower lever and the second upper lever to respectively pivot out of engagement with each respective said one of the second plurality of apertures to unlock the second stabilizer bar with respect to the second upper vertical adjustment bar to allow the second stabilizer bar to slide within said second upper vertical adjustment bar while extending substantially perpendicularly away from said second upper vertical adjustment bar.

17. The ladder safety accessory kit of claim 16 further comprising:

a first safety lock located on the first upper vertical adjustment bar below the proximal end of the first stabilizer bar; and a second safety lock located on the second upper vertical adjustment bar below the proximal end of the second stabilizer bar.

18. The ladder safety accessory kit of claim 16 further comprising:

at least one crossbar attached to the first stabilizer bar and the second stabilizer bar.

19. The ladder safety accessory kit of claim 16 further comprising:

at least one pin for securing the two substantially tubular-shaped members attached to the first upper vertical adjustment bar within the at least two of the plurality of rungs located on the ladder; and at least one pin for securing the two substantially tubular-shaped members attached to the second upper vertical adjustment bar within the at least two of the plurality of rungs located on the ladder.

20. The ladder safety accessory kit of claim 16 further comprising:

at least one cap located on the first upper vertical adjustment bar; and at least one cap located on the second upper vertical adjustment bar.

21. The ladder safety accessory kit of claim 16 further comprising:

a lower stabilizer assembly having a first lower vertical adjustment bar and a second lower vertical adjustment bar;

a first leg that is slidably attached to the first lower vertical adjustment bar;

a first foot pivotally attached to the first leg;

a second leg that is slidably attached to the second lower vertical adjustment bar;

said first lower vertical adjustment bar having at least two substantially tubular-shaped members extending from a side surface of a first side of the first lower vertical adjustment bar so that each of the at least two substantially tubular-shaped members extending from the first lower vertical adjustment bar are perpendicular to the first lower vertical adjustment bar, said at least two substantially tubular-shaped members extending from the first lower vertical adjustment bar are configured to allow a user to attach the first lower vertical adjustment bar to the first one of the sides of the ladder by inserting the at least two substantially tubular-shaped members extending from the first lower vertical adjustment bar into at least two of the plurality of rungs located on the ladder; and said second lower vertical adjustment bar having at least two substantially tubular-shaped members extending from a side surface of a first side of the second lower vertical adjustment bar so that each of the at least two substantially tubular-shaped members extending from the second lower vertical adjustment bar are perpendicular to the second lower vertical adjustment bar, said at least two substantially tubular-shaped members extending from the second lower vertical adjustment bar are configured to allow a user to attach the second lower vertical adjustment bar to the second one of the sides of the ladder by inserting the substantially tubular-shaped members extending from the second lower vertical adjustment bar into at least two of the plurality of rungs located on the ladder.

* * * * *